US006880867B2

(12) United States Patent
Schoen et al.

(10) Patent No.: US 6,880,867 B2
(45) Date of Patent: Apr. 19, 2005

(54) VEHICLE DOOR LATCHING MECHANISM HAVING AN IMPROVED LINK ROD

(75) Inventors: Robert M Schoen, West Bloomfield, MI (US); Istvan Rozsa, Royal Oak, MI (US); Dale L Gratton, Royal Oak, MI (US); David R. Carr, Novi, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/459,942

(22) Filed: Jun. 12, 2003

(65) Prior Publication Data

US 2004/0251693 A1 Dec. 16, 2004

(51) Int. Cl.[7] ..... E05C 3/06

(52) U.S. Cl. ..... 292/216; 292/DIG. 22; 292/DIG. 65; 74/470

(58) Field of Search ..... 292/216, 201, 292/DIG. 23, DIG. 22, DIG. 65; 74/470

(56) References Cited

U.S. PATENT DOCUMENTS 2,590,238 A * 3/1952 Durham ..... 74/582
2,864,641 A * 12/1958 Leslie ..... 292/336.3
3,105,391 A * 10/1963 Thompson ..... 74/532
3,388,611 A * 6/1968 Clary et al. ..... 74/513
3,596,462 A 8/1971 Pollak
4,274,305 A * 6/1981 Roushdy ..... 477/156
4,283,155 A * 8/1981 Yamazaki et al. ..... 403/163
4,382,622 A 5/1983 Ishikawa
4,714,282 A * 12/1987 Henderson ..... 292/36
5,035,528 A * 7/1991 Thau ..... 403/290
5,069,493 A * 12/1991 Mochida et al. ..... 292/336.3
5,273,327 A * 12/1993 Johnson et al. ..... 292/336.3
5,431,462 A * 7/1995 Lignell ..... 292/336.3
5,584,516 A * 12/1996 Cetnar ..... 292/336.3
5,934,817 A * 8/1999 Kim et al. ..... 403/196

* cited by examiner

*Primary Examiner*—Gary Estremsky
(74) *Attorney, Agent, or Firm*—Ralph E. Smith

(57) ABSTRACT

A link rod flexibly connecting an exterior door handle of a motor vehicle and a door latching mechanism to prevent actuation of the door latching mechanism as the result of a lateral collision, the link rod comprising: a first section connected to the vehicle door handle; a second section operatively connected to the door latching mechanism; and a lateral connector operatively connecting the first section to the second section. The lateral connector may be a laterally flexible spring, laterally flexible synthetic material, or a hinge point.

11 Claims, 5 Drawing Sheets

VEHICLE DOOR LATCHING MECHANISM HAVING AN IMPROVED LINK ROD

FIELD OF THE INVENTION

The present invention relates to a latch mechanism for a vehicle door. More specifically, the present invention describes an improved link rod for connecting the exterior door handle and the door latch mechanism that prevents latch release during lateral impact.

BACKGROUND OF THE INVENTION

Early motorized vehicles were little more than horse drawn carriages with a motor replacing the horses. Doors on these early vehicles were simple affairs. A single piece of material, such as wood or metal, was hinged on one side and secured with a simple latch. The mechanism was no more complicated than what currently might be used on a garden gate.

In contrast, modern motorized vehicles are infinitely more sophisticated. Not surprisingly, the doors on modern vehicles have gone well beyond their simple origins. Features like powered windows and locks and their associated controls are now considered standard as are a variety of related safety features.

The mechanism for opening the door on a modern vehicle, however, remains primarily mechanical. Handle assemblies are provided on the inside and outside of the vehicle. These handles are linked to the latch mechanism. When pulled, the handle moves a link rod that in turn activates the door latch.

Unfortunately, in an accident involving a lateral impact the outer door handle's inertia keeps it in place, while the force of the impact moves the vehicle. This produces a relative movement of the door handle, in response to this relative movement, the link rod moves, and the door latch is actuated. This creates the potential for a number of undesirable situations during an accident: an occupant of the vehicle could be ejected; the door could open and then close on an occupant's arm or leg; accident debris could be projected into the vehicle interior; etc.

One common solution to this problem is to incorporate a weight equal in mass to the door handle to counterbalance it and overcome its inertia. Another solution involves incorporating a weighted pendulum of lesser inertia that responds to the forces generated by a lateral impact more rapidly that the door handle. On a lateral impact this weighted pendulum is effectively moved into a blocking position that immobilizes the door handle. Still another solution is to provide a latching mechanism for the door handle that must be released to open the door.

Some solutions to this problem are specifically described in the following references:

- U.S. Pat. No. 3,967,844 describes a double action door handle. The first action on the handle depresses a spring that unlocks the handle from a base member, and the second action permits actuation of the door latch.
- U.S. Pat. No. 5,431,462 describes a door handle connected to the latch mechanism via a two piece linkage having a pivot point positioned below the latch assembly. Outward movement of the door is translated to press the first half of the linkage downward. This downward travel is translated through the pivot point to the second half of the linkage to actuate the latch.
- U.S. Pat. Nos. 5,669,642 and 6,464,270 B1 each describe a door handle containing a pivoting weight. The weight acts has a pendulum that rotates on lateral impact to block outward travel of the door handle.
- U.S. Pat. No. 6,447,030 describes a resilient finger combined with a detent. Gradual pressure on the door handle causes the detent to depress and slide around the resilient finger. On rapid lateral acceleration the detent catches on the resilient finger and prevents movement of the door handle and actuation of the door latch.

Prior art solutions, particularly those described in described in U.S. Pat. Nos. 3,967,844; 5,669,642; 6,447,030; and 6,464,270 B1 are relatively complex, difficult and expensive to manufacture, more likely to fail, and difficult to maintain and repair.

While the mechanism described in U.S. Pat. No. 5,432,462 appears somewhat efficient at first glance, a careful reading of this reference reveals a number of significant problems. The described mechanism is loosely fitted (see, FIG. 3 and related text). In order to adequately transmit opening force and reduce rattling during operation of the vehicle stabilizing brackets must be used (see, FIGS. 4–7 and related text). At best the described designs require complex tuning to achieve operational reliability. At worst, the described designs do not sufficiently decouple the handle's inertia from the activating arms to prevent a door from opening during lateral impact.

SUMMARY OF THE INVENTION

One object of the present invention is simplified mechanism to prevent opening of a vehicle door as a result of lateral acceleration.

Another aspect of the present invention is a simplified mechanism to prevent opening of a vehicle door on lateral acceleration that is easy to manufacture, reliable, and simple and inexpensive to repair.

These and other objects of the invention are satisfied by a link rod flexibly connecting an exterior door handle of a motor vehicle and a door latching mechanism to prevent actuation of the door latching mechanism. The link rod comprises a first section connected to the vehicle door handle; a second section connected to the door latching mechanism; and a lateral connector operatively connecting the first section to the second section. The lateral connector can be a laterally flexible spring, flexible material, or hinge point.

Other objects of the invention are satisfied by a link rod flexibly connecting an exterior door handle of a motor vehicle and a door latching mechanism to prevent actuation of the door latching mechanism as a result of a lateral collision. The link rod comprises a first section connected to the vehicle door handle; a second section connected to the door latching mechanism; and a first retainer attached to the first section distal to the door handle; a second retainer attached to the second section distal to the door latching mechanism; at least one resilient strip embedded in the first retainer and the second retainer to operatively connect the first section and the second section.

DESCRIPTION OF THE INVENTION

Figure 1:
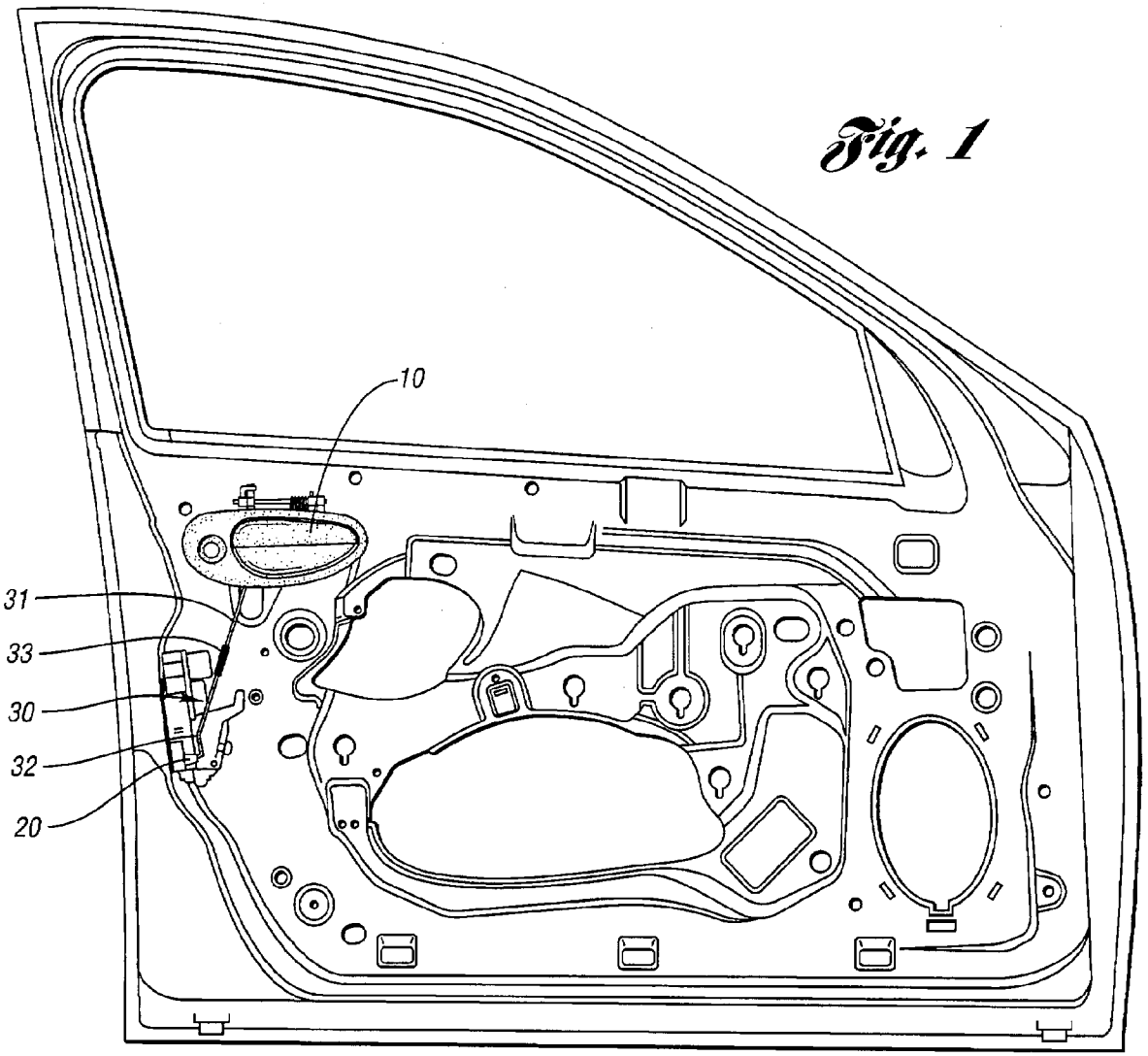
FIG. 1 is a perspective view of a motor vehicle door showing the exterior door handle, the link rod according to an embodiment of the present invention, and the latch mechanism.

The present invention provides a simple but elegant solution to the limitations of the prior art as discussed above. The present invention is based on a link rod design that is easy and inexpensive to manufacture, unlikely to fail, and simple to repair and replace if necessary. Such a link rod comprises a first section and a second section joined by a lateral connector.

As used herein, a lateral connector is a connecting device that permits the fist section and the second section to move laterally while permitting, at most, minimal longitudinal motion of the first and second sections relative to each other.

If an accident occurs that involves a lateral impact into a door having a door handle, link rod, and latch mechanism according to the present invention, the force generated by the impact acts on the first section and the second section joined by the lateral connector prior to acting on the door handle causing the link rod to buckle at the point where the first section is connected to the second section. This force results in the relative movement of the first and second ends and the lateral connector toward the exterior of the door effectively decoupling the door handle from the latch mechanism. Thus, when the relative movement of the door handle occurs, the link rod does not actuate the latch mechanism and the door remains secure. When the acceleration ceases, the first section and the second section return to their original configuration and the coupling between the door handle and the latch mechanism is restored.

Described herein are a variety of lateral connectors for joining the first section of the link rod and the second section of the link rod. For example, the lateral connector may be a laterally bendable and resilient spring(s), tube(s), flexible rod(s), etc. of any material or construction. The lateral connector, or similar structure, is configured to surround or attach to the first section distal to the door handle and the second section distal to the latching mechanism.

By using a pair of retainers, almost any material having the desired laterally flexibility, such as flat spring steel, flexible resilient plastic, or reinforced resilient flexible plastic can be used to connect the first section to the second section through the use of a pair of retainers. Each retainer may be in the form of a block of metal or plastic material or a mechanical clamp and serves to connect the ends of one, two, three, or more sections of laterally flexible material to the first section distal to the door handle and the second section distal to the latching mechanism. Additionally, connector pins may be embedded in the retainers and a spring clamp, resilient ring, etc may be used as the lateral connector to join the first and second sections. Further, only a single retainer on the first section may be used to secure a flexible and resilient lateral connector that is sized to act as the lateral connector and the second section.

Alternatively, the lateral connector may be a hinged device, configured with a spring or equivalent biasing mechanism to permit lateral flex, without extension or longitudinal flex.

If the lateral force generated against the door does not crush the door, the lateral connector will restore the displaced ends of the first section and second section of the link rod to the operative position. This permits the door to operate normally.

Figure 2:
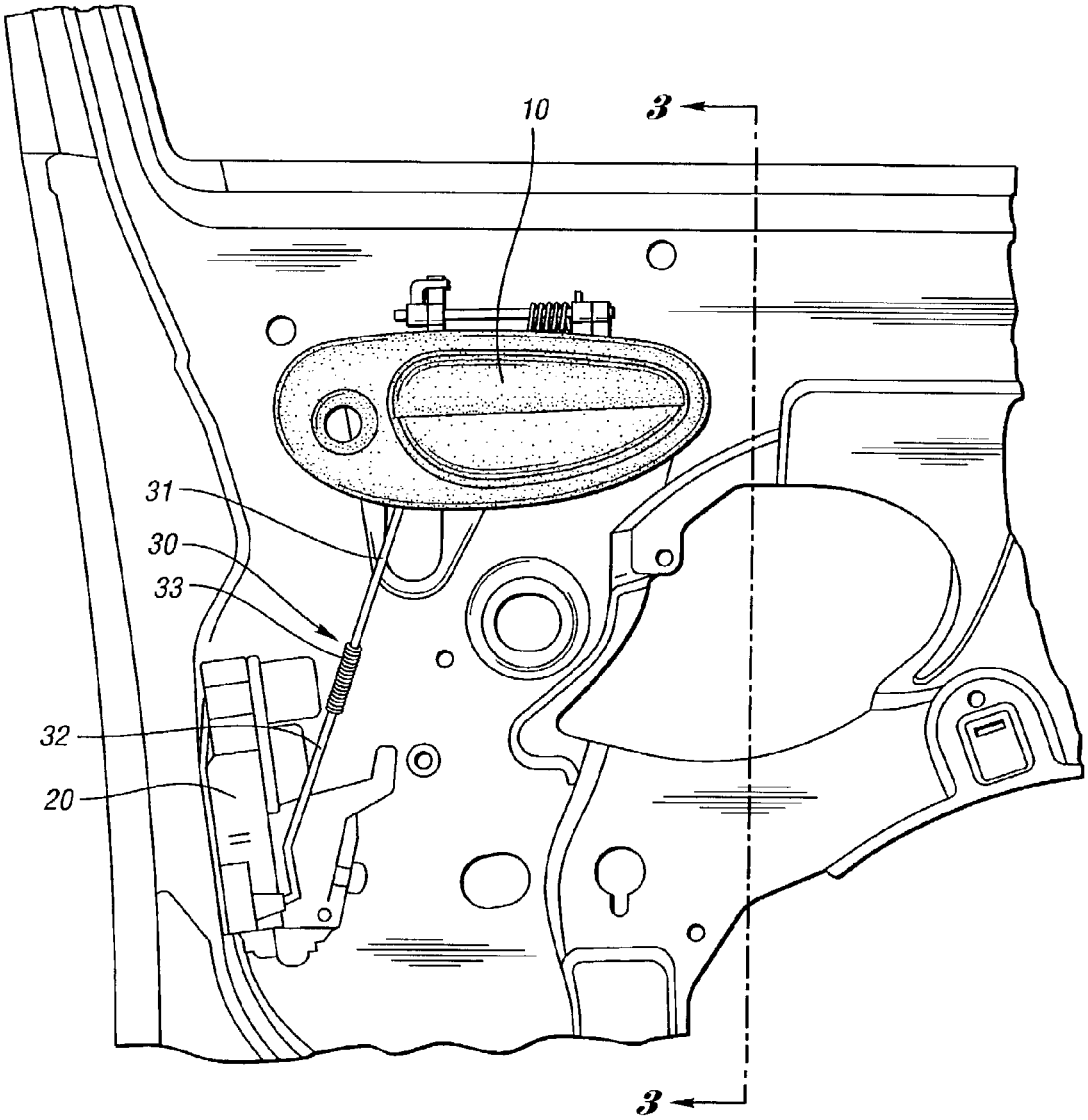
FIG. 2 is a close up of the embodiment shown in of FIG. 1.
Figure 4:
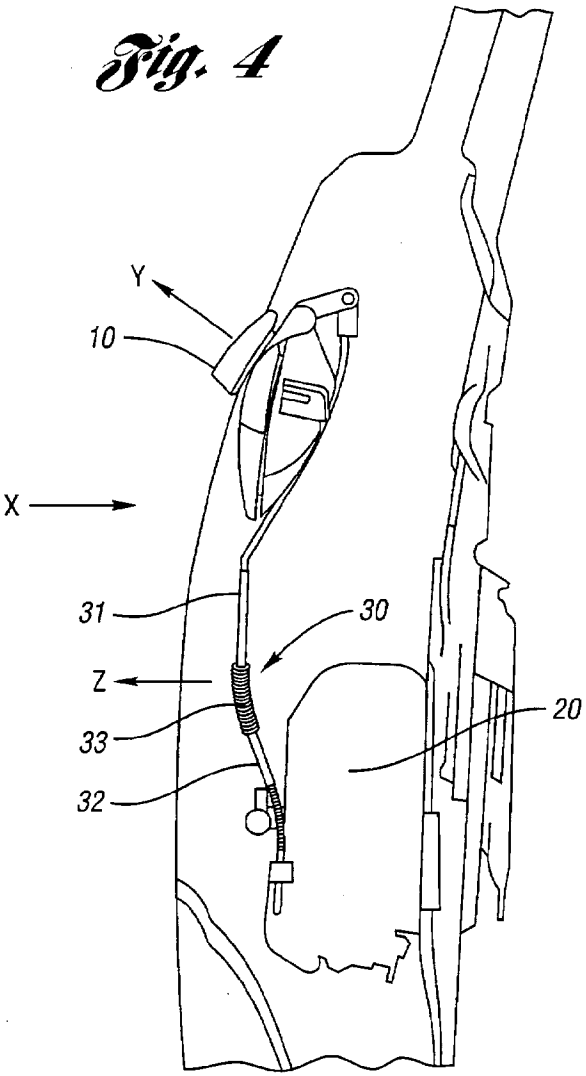
FIG. 4 illustrates the components shown in FIG. 3 positioned as they would be following a lateral impact.
Figure 3:
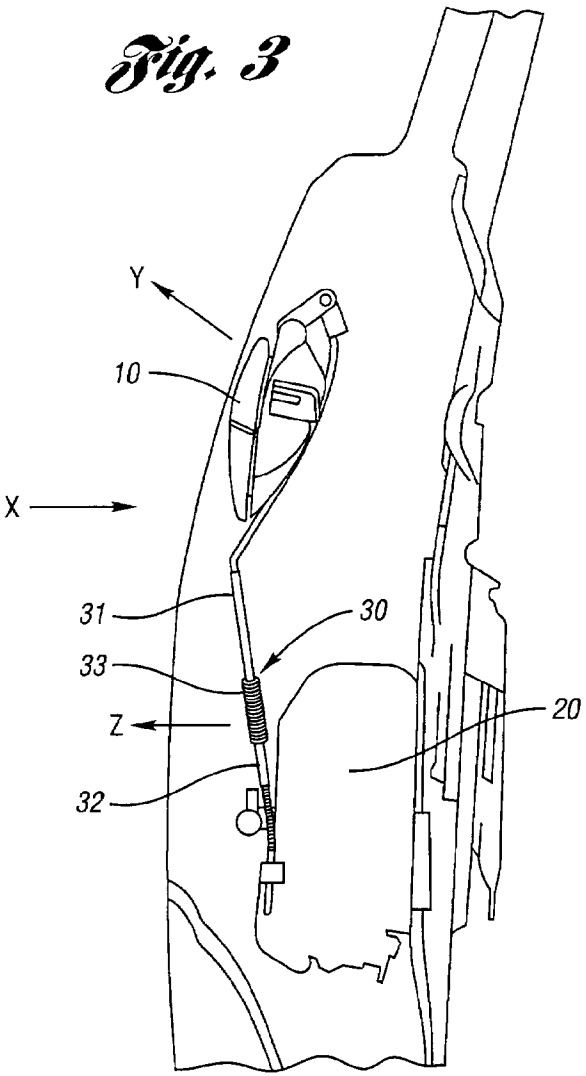
FIG. 3 is a cross sectional view looking from section line A shown in FIG. 1 toward the rear portion of the motor vehicle door.
Figure 5:
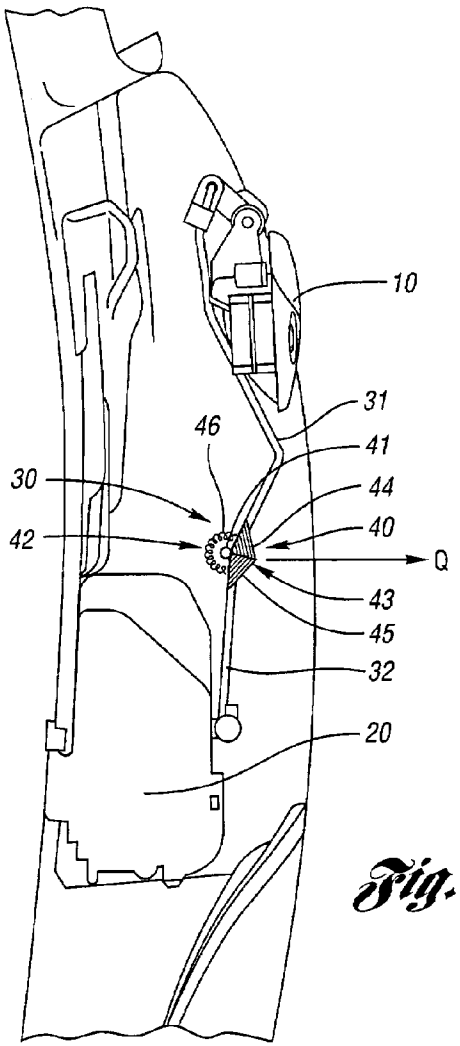
FIG. 5 is a cross sectional view from the rear edge of the motor vehicle door showing an alternate embodiment of the invention.

In the Figures and Description, like numbers are used herein to refer to like components. Further, the term "front" or "forward" as used specifically refers to the forward part of the vehicle; "rear" or "rearward" as used specifically refers to the rear part of the vehicle; "outer" or "outside" specifically means away from the center or interior of the vehicle; and "inner" or "inside" specifically means toward the center of the vehicle. In FIGS. 1 and 2, the front or hinge portion of the door is to the right side of the Figures. FIGS. 3 and 4 are cross sectional views through section line A, thus the view is from the front of the vehicle along the longitudinal axis of the door toward the rear of the vehicle. In FIG. 5, the view is from the rear of the vehicle along the longitudinal axis of the door toward the front of the vehicle.

FIGS. 1–4 illustrate an embodiment of a link rod according to the present invention. An exterior door handle 10 is connected to a latch mechanism 20 by the link rod 30. The link rod 30 comprises a first section 31 and a second section 32 joined by a lateral connector 33. In this embodiment, the lateral connector 33 may be a bendable spring, a tube of laterally flexible resilient elastic material such a rubber, synthetic rubber, or thermoplastic. (As used herein, a "lateral connector," "bendable spring," or "flexible tube," means a spring, hinge, or equivalent biasing mechanism that is configured to permit bending or flexing at a point.)

The effect of a lateral impact on the embodiment illustrated in FIGS. 1, 2, 3, and 4, is easiest to visualize by comparing FIGS. 3 and 4. In case of a lateral impact in the direction indicated by X, the inertia of the door handle 10 effectively lifts the handle in the direction Y. In the prior art, where the link rod 30 is solid the effective motion of the door handle 10 would result in the actuation of the door latch 20. In the present invention as illustrated in FIG. 4, during a lateral impact, the door handle 10 is effectively displaced in direction Y and the link rod 30 is effectively displaced in direction Z resulting from the effective lateral displacement of the lateral connector 33. The lateral displacement of the link rod 30 results in a "break" between the first section 31 and the second section 32 that decouples the door handle from the latch mechanism 20. Thus a lateral impact does not actuate the latch mechanism 20 and the vehicle door remains secured.

Figure 6:
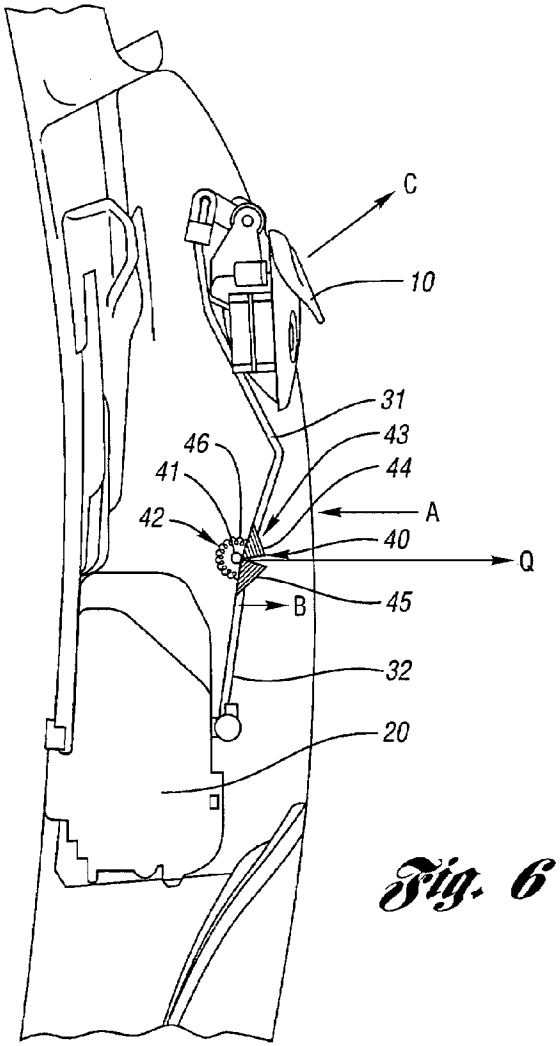
FIG. 6 illustrates the positioning of the components of the embodiment of FIG. 5 following a lateral impact.

An alternate embodiment of the invention is illustrated in FIGS. 5 and 6. In this embodiment, the link rod 30 comprises a hinged lateral connector 40 positioned to flex perpendicular to the motor vehicle's direction of travel, illustrated by axis Q (or parallel to a lateral impact). The hinged lateral connector 40 comprises a pivot point 41 having an inner side 42 and an outer side 43. Attached to the outer side 43 on the first section 31 is a first stop 44, and on the second section 32 is the second stop 45. A longitudinal biasing device 46, is attached to the hinged lateral connector 40 on the inner side 42 of the link rod 30 (on the opposite side of the lateral connector 40 from the first stop 44 and the second stop 45). The longitudinal biasing device 46, which may be a metallic or synthetic spring or the like, is attached to forcefully bridge between the first section 31 and the second section 32 of the link rod 30 and thereby keep the first stop 44 in contact with the second stop 45 as illustrated in FIG. 5. The longitudinal biasing device 46 may be a spring, a strip of elastic material, etc., or equivalent biasing mechanism that is configured to permit bending or lateral displacement as illustrated.

During normal operation, the biasing device 46 forces the first stop 44 into contact with the second stop 45 thereby providing operational connection between the door handle and the latch mechanism 20. Thus when the door handle 10 is pulled, this force is transmitted through the link rod 30 to actuate the latch mechanism 20.

The effect of a lateral impact on the embodiment illustrated in FIGS. 5 and 6 is shown in FIG. 6. During a lateral impact in the direction indicated by A, the inertia of the hinged lateral connector 40 overcomes the force exerted by the biasing device 46, stop 44 and stop 45 move away from each other, and the hinged lateral connector 40 is effectively displaced, in the direction Q, relative to the door handle 10 and the latch mechanism 20. This effective movement produces a "break" in the link rod 30, thereby decoupling the door handle 10 from the latch mechanism 20. Thus when the inertia of the door handle 10 effectively lifts the handle in the direction C the latch mechanism 20 is not actuated and the vehicle door remains secured.

The hinged lateral connector 40 may be any jointed device such as a conventional hinge having interlocking components that may or may not be held together by a pin or other pivot point. Alternatively, the hinged lateral connector 40 may be a "living hinge," that is a plastic or other flexible material that is not resilient or elastic. (Plastic living hinges are most frequently seen on all plastic ice chests.)

Figure 7:
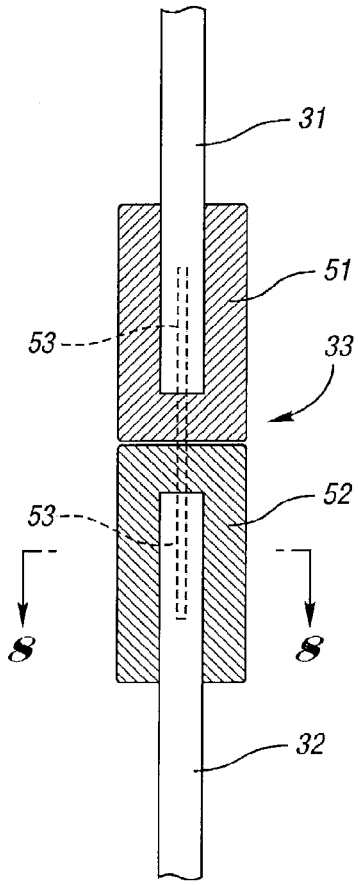
FIG. 7 is a longitudinal section of another embodiment of a lateral connector according to the invention.
Figure 8:
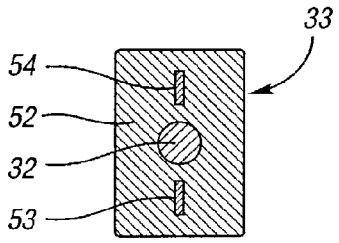
FIG. 8 is a cross section of the lateral connector of FIG. 7 along section line B.

An additional embodiment of the lateral connector 30 of the present invention is illustrated in FIGS. 7 and 8 and comprises a first retainer 51 attached to the first section 31, a second retainer 52 attached to the second section 32. Shown embedded in the first retainer 51 and the second retainer 52 are resilient strips 53, 54. These resilient strips 53, 54 may be formed from any material that can flex laterally without elongation such as spring steel strips, or strips of any other flexible metal or polymer material. (Alternatively, any these resilient strips may be replace with any lateral connector described herein.)

In case of a lateral impact, the embodiment illustrated in FIGS. 7 and 8 responds in the same manner as the lateral connector 33 described above. That is, on lateral impact the retainers 51 and 52 are effectively displaced relative to the door handle 10 and the latch mechanism 20 as the resilient strips 53, 54 flex. This effective displacement results in a "break" between the first section 31 and the second section 32 that decouples the door handle from the latch mechanism 20.

A variation of the embodiment illustrated in FIGS. 7 and 8 that is not illustrated involves embedding resilient strips and "living hinge" material (flexible, non-resilient) in the retainers.

Figure 9:
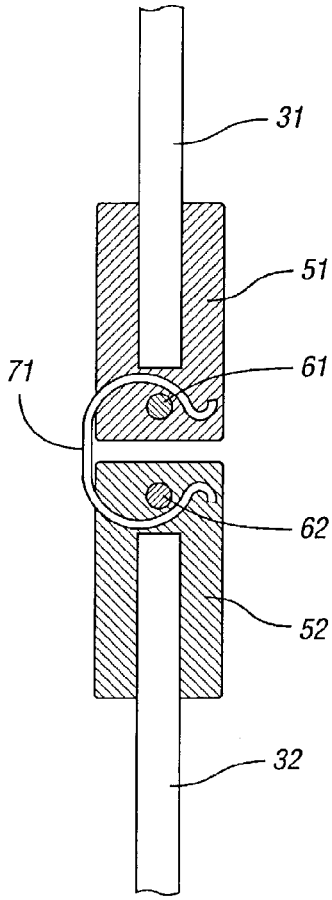
FIG. 9 is a variation of the lateral connector illustrated in FIGS. 7 and 8.

FIG. 9 illustrates another variation of the embodiment shown in FIGS. 7 and 8. A first retainer 51 is attached to the first section 31, and a second retainer 52 is attached to the second section 32. Embedded in the first retainer 51 and the second retainer 52 are retaining pins 61, 62. (The retaining pins 61, 62 may also be formed integrally in retainer 51 and 52.) A spring clip 71 captures the retaining pins 61, 62. In case of a lateral impact, the spring clip 71 permits the effective lateral displacement of the retainers 51, 52. This results in a "break" between the first section 31 and the second section 32 that decouples the door handle from the latch mechanism 20.

Figure 10:
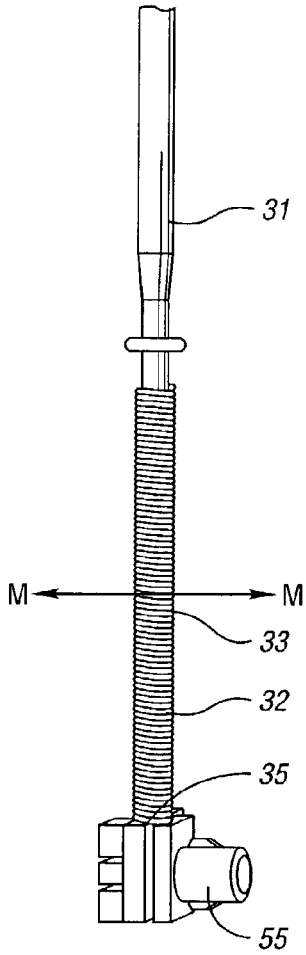
FIG. 10 is an alternative embodiment of a lateral connector of the invention.

FIG. 10 illustrates how the lengths of the first section 31 and the second section 32 may be varied in order to meet the requirements of various specific applications of the present invention. In this embodiment, the first section 31 is inserted into a lateral connector 33 (shown as a spring) up to the section line M. In this embodiment, a portion of the spring acts as the lateral connector 33 and another portion of the spring acts as the second section 32. The free end of the spring 35 is secured in a retainer 55 that connects directly to the door latch mechanism. Advantageously, this embodiment uses fewer parts making it simple and inexpensive.

Depending on the actual configuration of the door handle, link rod, and latching mechanism, it may be desirable to configure the lateral connectors as described herein to decouple the door handle from the latching mechanism at certain levels of lateral acceleration. Preferable, the lateral connectors are configured to decouple the door handle and the latching mechanism when the lateral acceleration exceeds a minimum value determined by vehicle characteristics, such as overall vehicle mass, door and body side structure, position of the door, handle and latch to the ground, routing of the link rod in the door, etc. Preliminary evaluations on mini-van models indicate around 90 g would be an appropriate minimum value.

While specific embodiments of a lateral connector have been disclosed and described herein, alternative embodiments of these and other components of the invention will occur to those of skill in the art such as varying the lengths of the sections 31, 32 or having portions of the lateral connector 33 serve a dual purpose. Also, the embodiment illustrated in FIGS. 7 and 8 could be configured with three, or four or more resilient strips embedded in the retainers 51 and 52 and still fall within the scope of the present invention. Other obvious variations will be suggested through improvements and new developments of appropriate resilient metal and thermoplastic materials, for example, that can be readily adapted by one skilled in the art. Accordingly, the scope of this invention is to be considered limited only by the following claims.

What is claimed is:

1. A link rod flexibly connecting an exterior door handle of a motor vehicle and a door latching mechanism to prevent actuation of said door latching mechanism as a result of a lateral collision, said link rod comprising:

a first section connected to said vehicle door handle;

a second section operatively connected to said door latching mechanism; and a lateral connector operatively connecting said first section to said second section; where said lateral connector comprises a hinge point positioned to flex parallel to a lateral impact and said hinge point comprises:

a pair of stops oriented outward on said hinge point, one adjacent said first section, and one adjacent said second; and a longitudinal biasing device oriented inward on said hinge point and opposite said pair of stops, said biasing device positioned to bridge between said first section and said second section and maintain said first stop in contact with said second stop.

2. The link rod of claim 1, where said longitudinal biasing device comprises a longitudinally flexible spring.

3. A link rod flexibly connecting an exterior door handle of a motor vehicle and a door latching mechanism to prevent actuation of said door latching mechanism as a result of a lateral collision, said link rod comprising:

a first section connected to said vehicle door handle;

a second section operatively connected to said door latching mechanism; and a first retainer attached to said first section distal to said door handle;

a second retainer attached to said second section distal to said door latching mechanism; and a lateral connector embedded in said first retainer and said second retainer operatively connecting said first section to said second section;

where said lateral connector comprises at least one resilient strip.

4. The link rod of claim 3, where said lateral connector comprises a laterally flexible spring.

5. The link rod of claim 3, where said lateral connector comprises a laterally flexible synthetic material.

6. The link rod of claim 5, where said laterally flexible synthetic material is a laterally flexible thermoplastic.

7. The link rod of claim 3, where said lateral connector comprises a hinge point positioned to flex parallel to a lateral impact.

8. The link rod of claim 7, where said hinge point comprises:

a pair of stops oriented outward on said hinge point, one adjacent said first section, and one adjacent said second; and a longitudinal biasing device oriented inward on said hinge point and opposite said pair of stops, said biasing device positioned to bridge between said first section and said second section and maintain said first stop in contact with said second stop.

9. The link rod of claim 8, where said longitudinal biasing device comprises a longitudinally flexible tube.

10. The link rod of claim 8, where said longitudinal biasing device comprises a longitudinally flexible tube.

11. The link rod of claim 1, where said longitudinal biasing device comprises a longitudinally flexible synthetic material.

* * * * *